US006193066B1

(12) United States Patent
Kilmartin, III et al.

(10) Patent No.: US 6,193,066 B1
(45) Date of Patent: Feb. 27, 2001

(54) DISPLAY PAD

(75) Inventors: John D. Kilmartin, III; Larry B. Johnson, both of Providence, RI (US)

(73) Assignee: International Packaging Corporation, Pawtucket, RI (US)

( * ) Notice: Subject to any disclaimer, the term of this patent is extended or adjusted under 35 U.S.C. 154(b) by 0 days.

(21) Appl. No.: 09/428,105

(22) Filed: Oct. 27, 1999

(51) Int. Cl.[7] ..... A45C 11/04
(52) U.S. Cl. ..... 206/495; 206/6.1
(58) Field of Search ..... 206/6.1, 443, 486, 206/490, 495, 563, 562, 581

(56) References Cited

U.S. PATENT DOCUMENTS

| | | | |
|---|---|---|---|
| 1,231,674 | 7/1917 | Underwood . | |
| 2,676,699 | 4/1954 | Friedman . | |
| 2,867,053 | 1/1959 | Boor . | |
| 4,099,611 | 7/1978 | Feibelman . | |
| 4,181,224 | 1/1980 | Aber . | |
| 4,420,084 | 12/1983 | Whelan . | |
| 4,732,269 | 3/1988 | Roy . | |
| 4,787,516 | 11/1988 | Morrison . | |
| 4,848,586 | 7/1989 | Jasik . | |
| 4,905,821 | 3/1990 | Corbett . | |
| 4,928,821 * | 5/1990 | Belko, Jr. | 206/562 |
| 5,025,918 | 6/1991 | Bergeron . | |
| 5,035,319 | 7/1991 | Kunisch . | |
| 5,427,230 | 6/1995 | Mattox . | |

* cited by examiner

*Primary Examiner*—David T. Fidei
(74) *Attorney, Agent, or Firm*—Salter & Michaelson

(57) ABSTRACT

A multiple-layer pad including an upper, middle and bottom layer for mounting any of a variety of ornamental articles is provided. The middle layer includes a plurality of mounting holes disposed therethrough which provide a user with a number of predetermined points through which to mount the ornamental article. The holes provide flexibility to the user by allowing the user to mount different types of ornamental articles on different locations on the pad, and to use a variety of mounting techniques. The upper layer of the pad provides an attractive display surface and is preferably wrapped around the edges of the middle layer and secured to the back of the middle layer in order to hold the two layers together. The bottom layer provides a finished backing for the pad and preferably includes a plurality of holes which are aligned with the holes in the middle layer so that the user can easily identify the position of the middle layer mounting holes during use.

20 Claims, 5 Drawing Sheets

DISPLAY PAD

DESCRIPTION

1. Technical Field

The invention relates generally to a display pad, and more particularly to a pad for displaying a variety of ornamental articles.

2. Background of Related Art

When packaging and displaying an ornamental article, such as a piece of jewelry, the article is often placed in a box which can be given to the consumer after purchase. Such boxes provide an appealing visual display, while also functioning as a storage or travel container. These boxes generally include a top portion hinged to a bottom portion, and a display pad onto which the article is mounted. The display pad secures the articles within the box while also providing a visually pleasing background to the articles. Various types of ornamental articles are displayed and packaged in this manner including, for example, cuff links, earrings, necklaces and pendants. Due to the variety of articles displayed on such pads, various different types of attachment methods have been developed to secure the different types of articles to the display pad.

One such method includes forming a pair of holes through the pad for receiving the posts of an article, such as pierced earrings, in order to fasten the article to the pad. Another such method involves providing a separate fastener for securing the article, such a pendant or cuff links, to the pad. Finally, slits may be provided in opposite corners of the pad for receiving a chain therein. As can be readily appreciated, mounting various articles to the display pad can be a labor-intensive activity. In addition, different style pads have been utilized to accommodate the various style ornamental articles and their associated mounting needs. While generally acceptable, the number of different style pads increases a vendor's inventory and potential cost associated therewith.

There is therefore needed in the art a pad for displaying ornamental articles which may readily be used to mount any of a variety of ornamental articles.

Accordingly, it is an object of the present invention to provide a universal pad for displaying and packaging ornamental articles which can be used with any of a variety of ornamental articles and associated mounting techniques.

SUMMARY

In accordance with the present invention, there is provided a multiple layer pad for mounting a variety of ornamental articles thereon. The multi-layer pad preferably includes a middle layer having a plurality of pre-formed mounting holes disposed therethrough, and is sandwiched between an upper layer and a bottom layer. The plurality of holes in the middle layer provide the user with a number of predetermined points through which to readily mount an ornamental article. The holes thereby provide flexibility to the user by allowing the user to mount different types of ornamental articles on different locations on the pad, and to use a variety of mounting techniques. The upper layer of the pad provides an attractive display surface and is preferably wrapped around the edges of the middle layer and secured to the back of the middle layer in order to hold these two layers together. The bottom layer provides a finished backing for the pad and preferably includes a plurality of holes which are aligned with the holes in the middle layer so that the user can easily identify the position of the middle layer mounting holes during use. In one embodiment, the pad also includes an intermediate layer of material disposed between the upper layer and the middle layer for concealing the mounting holes to the purchaser. In another embodiment, preformed slits are provided inapposite corners of the middle and bottom layer of the pad for receiving a necklace therein upon the user cutting corresponding slits in the upper layer of the pad.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

Figure 1:
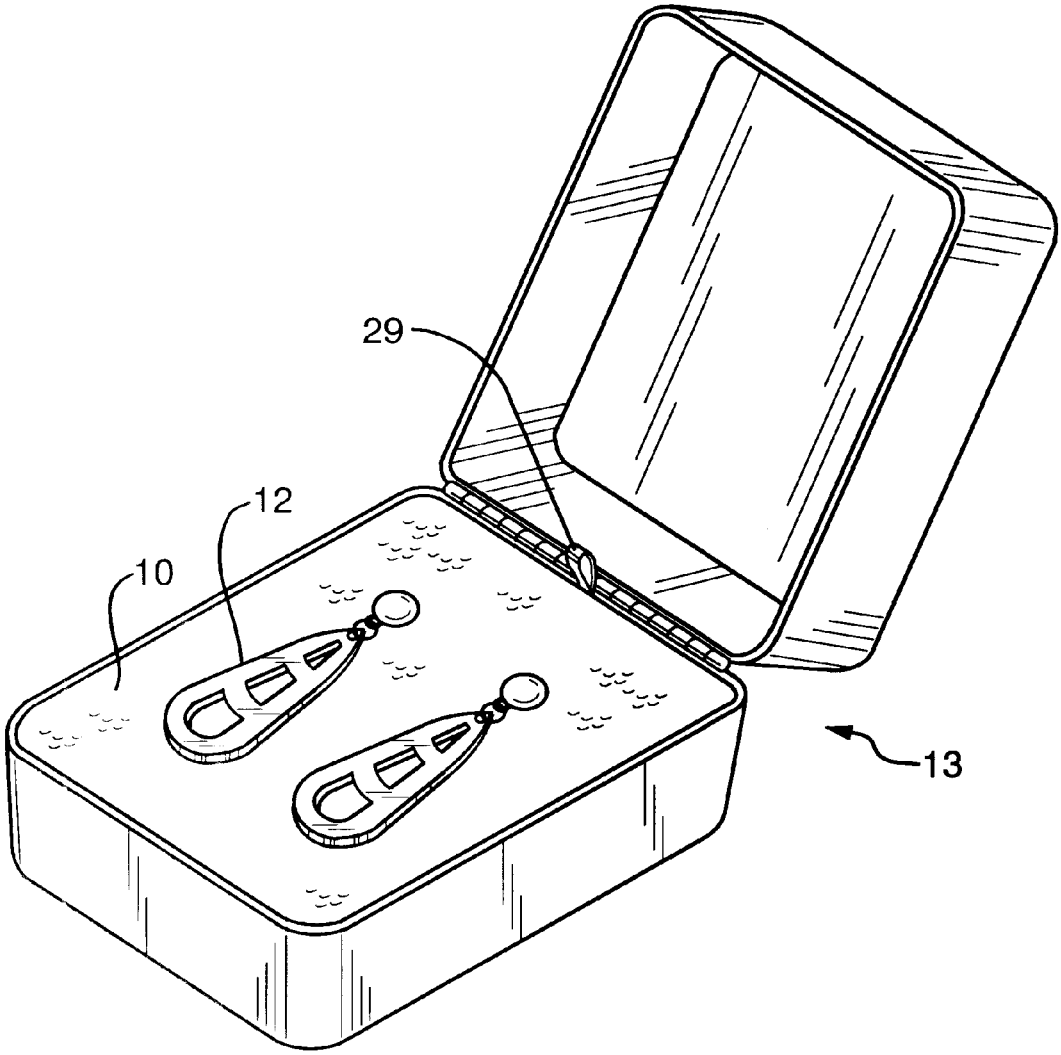
FIG. 1 is a perspective view of a mounting pad positioned within a box for mounting a variety of ornamental articles according to the present invention.

A pad 10 for mounting any of a variety of ornamental articles 12 in a display box 13 is illustrated in FIGS. 1–5F. The pad includes an upper layer 14 of material for displaying an ornamental article thereon, a mounting or middle layer 16 having a plurality of mounting holes 18 disposed therethrough for mounting the ornamental article, and a bottom layer 20 for providing a backing to the pad 10 and which likewise includes a plurality of holes 22 that are in substantial alignment with the plurality of holes 18 in the middle layer 16 in an assembled configuration. The plurality of holes 18 formed in the middle layer provide the user with a number of predetermined points through which to mount an ornamental article. By sizing the holes in the bottom layer of the pad smaller than the mounting holes in the middle layer and aligning the two sets of holes, a user is able to readily locate the holes in the middle layer of the pad when working from the bottom layer or back of the pad.

Figure 2:
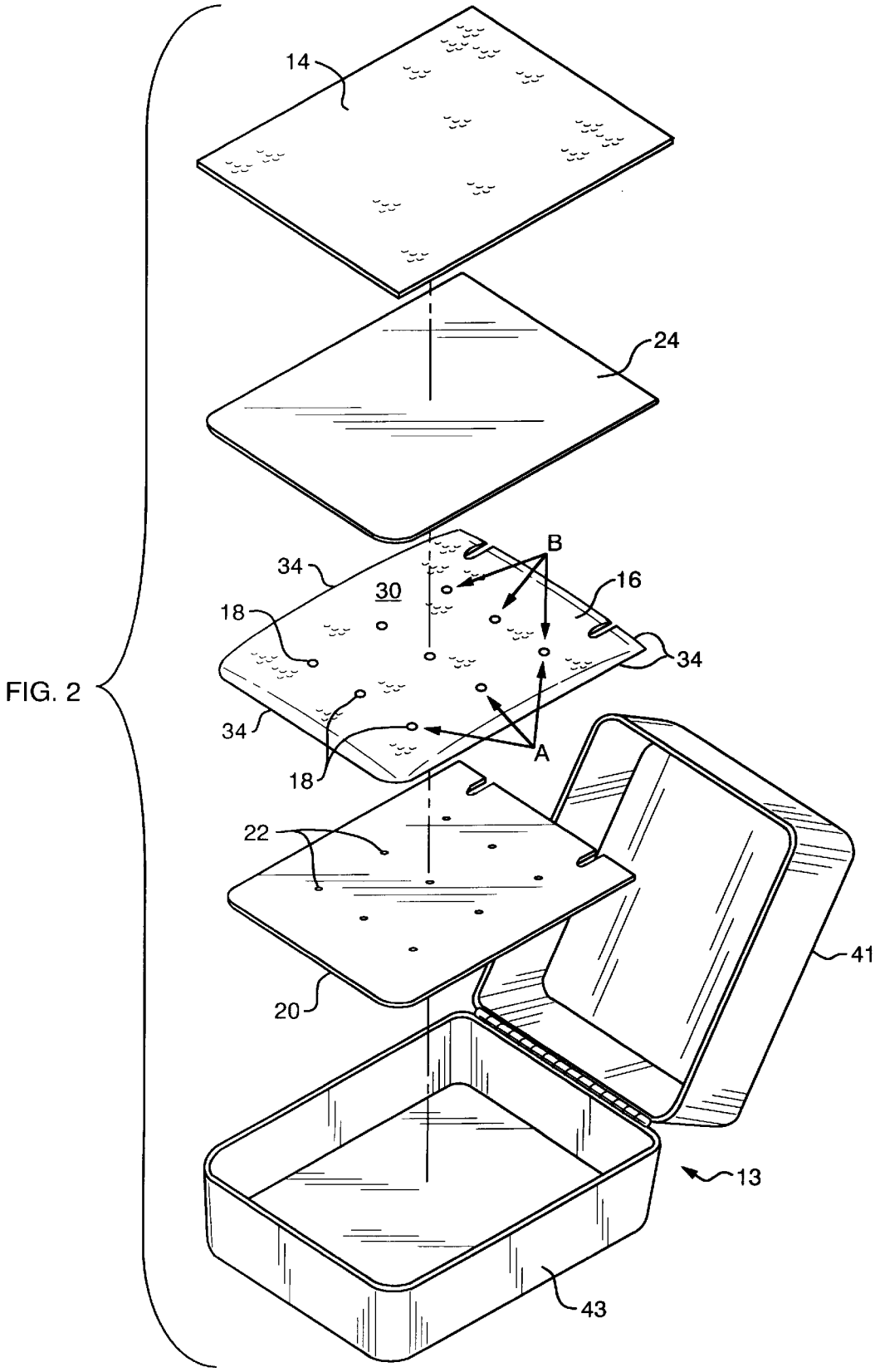
FIG. 2 is an exploded view of the mounting pad of FIG. 1.
Figure 3:
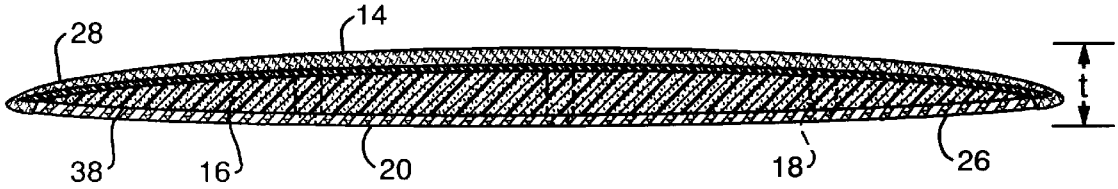
FIG. 3 is a cross-sectional view of the mounting pad of FIG. 1.
Figure 4:
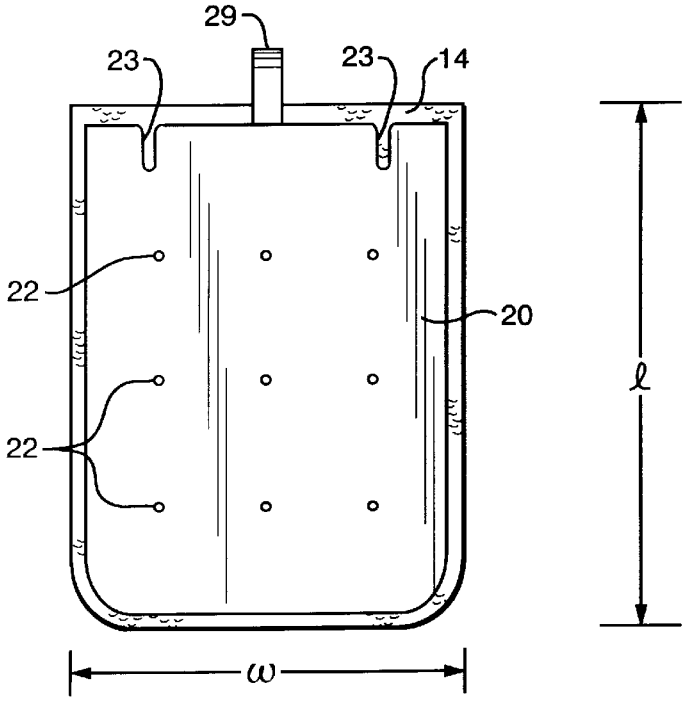
FIG. 4 is a rear view of the mounting pad of FIG. 1.

As shown in FIG. 2, the middle layer 16 of the pad may include any number of a plurality of holes 18 arranged in any manner or grouping, the holes preferably being arranged in multiple rows (A) and columns (B), in the present embodiment. The middle layer 16 may also preferably be cushioned, including a cushioning material 28 (FIG. 3) which covers a top surface of a support backing 26 (FIG. 3) so that the ornamental article is supported by the cushioning material in use. When utilizing a cushioned pad having both a backing 26 and a cushioning material 28, a first set of holes are preferably formed through the support backing 26, and a second set of holes are preferably formed through the cushioning material 28. The holes in the support backing 26 and the holes in the cushioning material 28 are preferably substantially the same size and in alignment with each other such that both set of holes together make up the plurality of holes 18 in the middle layer of the pad when utilizing a cushioned layer. The cushioning material 28 may be secured to the support backing 26, for example by adhesive, or the cushioning material may simply be placed on top of the support backing and not secured thereto, as would be known to one of skill in the art. The support backing may be made of a semi-stiff material, such as cardboard, and the cushioning material may be made of any cushioning material, such as foam, as would also be known to those of skill in the art.

As described above, the bottom layer 20 of the pad 10 includes a plurality of holes 22 disposed therethrough which are arranged in substantial alignment with the holes 18 in the middle layer of the pad when assembled, and which are preferably smaller in size (i.e. diameter), than the holes in the middle layer of the pad. The holes 22 in the bottom layer of the pad are preferably arranged and sized in this matter in order to act as a guide to the user for locating the mounting holes in the middle layer of the pad, and are also used to mount the ornamental article to the pad. Both the middle layer of the pad and the bottom layer of the pad are preferably generally U-shaped, as is conventional, with the bottom layer being slightly smaller in overall dimensions than the middle layer, as shown most clearly in FIG. 4. Pre-formed slits 23 may also be provided in opposite comers of the middle and bottom layers of the pad, for receiving a necklace therein upon the user cutting corresponding slits in the upper layer of the pad, as described in greater detail below. The bottom layer may preferably be made of a semi-stiff, relatively thin material, and may preferably be visually appealing (for example be white) since the bottom layer of the pad is visible when the pad is removed from the display box 13.

The upper layer 14 of the pad is used to display the ornamental article and is preferably made from any visually appealing material, for example flocking, woven velvets, polyurethane, etc. as would be known to one of skill in the art. The upper layer 14 is also used to hold the assembled pad together, and is preferably sized larger than the other layers of the pad so that the upper layer can at least partially wrap around the edges of the middle layer of the pad, as will be described in greater detail below. As shown in FIG. 2, an optional intermediate layer 24 may also be provided between the upper layer 14 and the middle layer 16 in order to conceal the mounting holes 18 on the middle layer from the consumer, for example when a light color upper layer (such as white) is utilized. The intermediate layer may be any type of material capable of shielding the mounting holes from the consumer, for example a heavy weight sheet of paper cut to an appropriate size may be utilized. A tab 29 may also be provided to aid in the removal of the pad 10 from within box 13. In the present embodiment, the tab 29 is configured as a loop and is mounted between the middle layer and bottom layer of the pad. Assembly and use of pad 10 will now be described with reference to the figures.

To assemble the multi-layer pad, at least an upper layer, a middle layer and a bottom layer are provided, as described above. The upper layer is placed onto a top surface 30 of the middle layer 16 such that it covers the top surface and overhangs outer edges 34 of the middle layer 16. If desired, intermediate layer 24 may be placed between the upper layer 14 and the middle layer 16 in order to conceal the mounting holes 18 in the middle layer from the consumer. The overhanging portion of the upper layer is then wrapped around the edges 34 of the middle layer and is secured to an underside 38 of the middle layer, for example by an adhesive such as glue. The upper layer should be secured to the perimeter of the underside 38 of the middle layer so as not to obstruct any of the holes 18 which have been pre-cut into the middle layer.

After covering and securing the upper layer to the middle layer, the bottom layer is then secured in order to complete the pad assembly. The bottom layer is placed onto the underside 38 of the middle layer so as to cover a majority of the underside, including a portion of the edge of the upper layer secured thereto, thereby providing the pad with a finished look (see FIG. 4). The bottom layer is positioned such that the pre-cut holes in the bottom layer are substantially aligned with the holes in the middle layer. The bottom layer is then secured to the underside of the middle layer, for example by adhesive, again being careful not to obstruct the holes in either the bottom or middle layer. The assembled pad may be any suitable shape and size (length, width and thickness), with the pad of the present embodiment being generally U-shaped and having an overall length "l" of about 3.5 inches, an overall width "w" of about 2.5 inches and a thickness "t of about 0.25 inches.

Figure 5A:
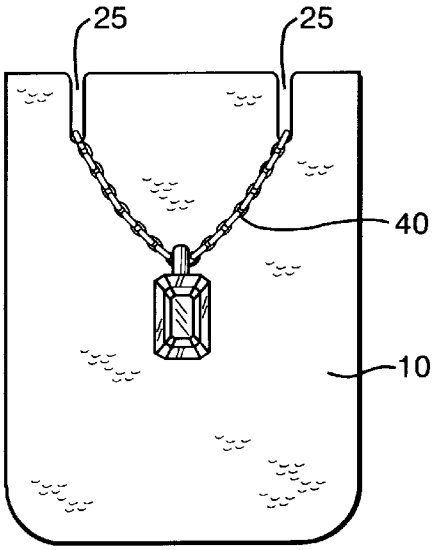
FIGS. 5A–5F are front views of the mounting pad of FIG. 1 with various ornamental articles mounted thereon.
Figure 5B:
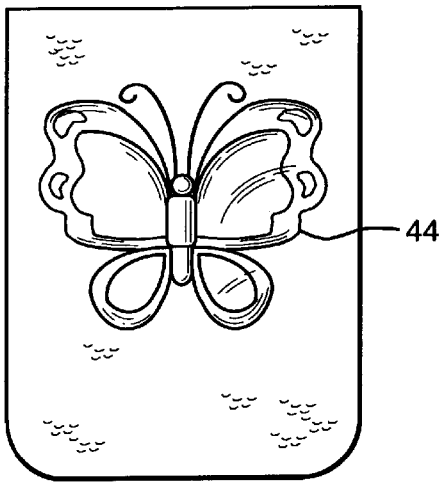
Figure 5C:
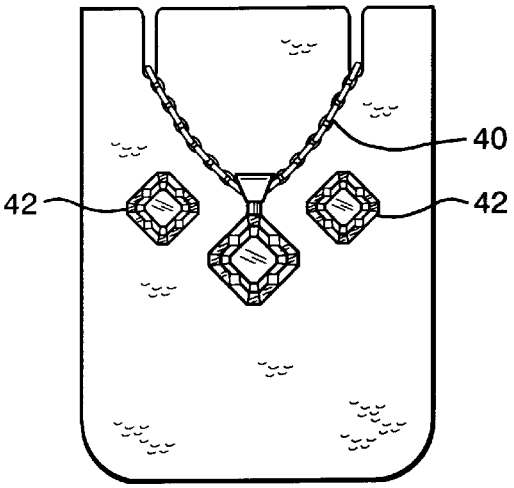
Figure 5D:
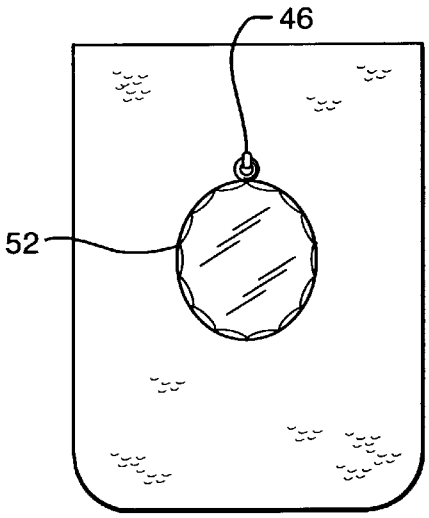
Figure 5E:
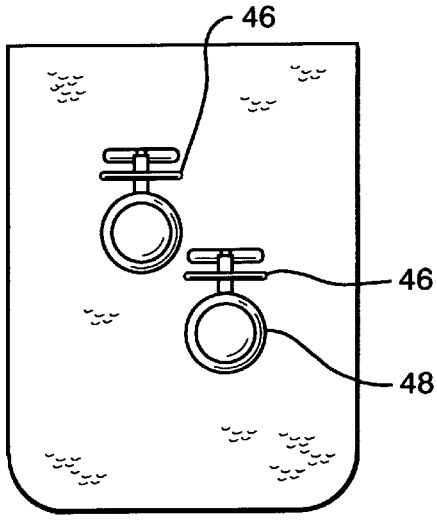
Figure 5F:
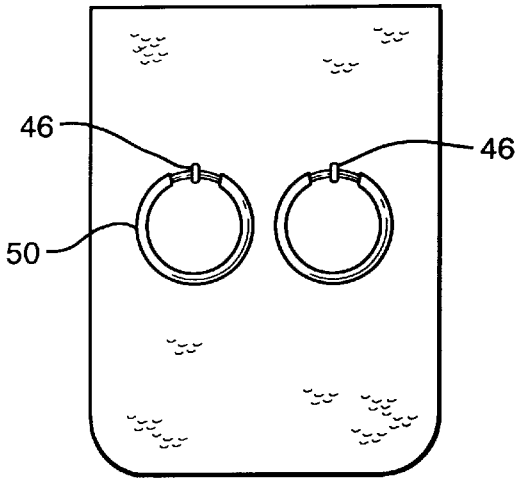

Once the multiple layer pad is assembled, the ornamental article may be mounted thereto. For example, when mounting a necklace 40 to the pad, the user first cuts slits 25 into the upper layer of the pad in alignment with the pre-formed slits 23 in the middle and bottom layers of the pad (FIG. 5A). Thereafter, the necklace is placed into the slits so that the necklace is draped over the pad 10. Earrings 42 may also be mounted onto the pad 10 as shown in FIG. 5C. When mounting post earrings to the pad, the shafts of the earrings are inserted through the holes in both the middle and bottom layers and the earring posts are used to secure the earrings thereto. A pin 44 (FIG. 5B) may likewise be secured to the pad by inserting the post of the pin through two or more holes and securing the post to the clasp of the pin. When mounting other ornamental items which do not have a shaft or a post that can be used as a mounting member and inserted into the mounting holes in the pad, such as cuff links 48 (FIG. 5E), hoop earrings 50 (FIG. 5F) or a pendant 52 (FIG. 5D), a separate mounting member 46 may be utilized in order to secure the ornamental items to the mounting holes and pad. As will be readily appreciated, the present invention provides a pad which can be utilized to mount a variety of ornamental items utilizing various mounting techniques, onto any desired predetermined locations on the pad. After mounting the ornamental article(s) onto the pad, the pad may be placed into display box 13 which includes a top portion 41 hinged to a bottom portion 43 for displaying and storing the ornamental article therein.

It will be understood that various modifications may be made to the embodiment disclosed herein. For example, the multiple layer pad may come in any variety of shapes, sizes, and colors. The pad may also be utilized in conjunction with a display and storage box, or without. In addition, the middle layer need not be cushioned, and any of a wide variety of materials may be utilized to form the various layers of the pad, other than those specifically disclosed herein. Therefore, the above description should not be construed as limiting, but merely as exemplifications of a preferred embodiment. Those skilled in the art will envision other modifications within the scope spirit of the invention.

What is claimed is:

1. A pad for mounting an ornamental article comprising:

an imperforate but penetratable upper layer constructed and arranged to display the ornamental article;

a middle layer having a plurality of mounting holes disposed therethrough, the holes being sized and arranged to provide a user with a number of predetermined points at which to mount the ornamental article; and a bottom layer including a plurality of holes;

wherein in an assembled configuration the plurality of holes in the bottom layer are substantially aligned with the plurality of mounting holes in the middle layer so that the user can easily identify the position of the mounting holes in the middle layer so as to readily mount the ornamental article to the pad.

2. The pad of claim 1, wherein in the assembled configuration a perimeter of the upper layer is wrapped around the edges of the middle layer and secured to a back surface thereof.

3. The pad of claim 1, further comprising an intermediate layer disposed between the upper layer and the middle layer in the assembled configuration.

4. The pad of claim 1, in combination with a display box having a top portion hinged to a bottom portion sized to receive the pad therein.

5. The pad of claim 1, wherein the middle layer includes a support backing having a top surface substantially covered with a cushioning material.

6. The pad of claim 1, wherein the mounting holes in the middle layer and plurality of holes in the bottom layer are arranged in multiple rows and columns.

7. The pad of claim 1, wherein the middle layer and the bottom layer include preformed slits provided in opposite comers thereof, the preformed slits being constructed and arranged to receive a necklace therein upon the user cutting corresponding slits into the upper layer of the pad.

8. A method of mounting an ornamental object onto a pad comprising the steps of:

providing a pad including an imperforate but penetratable upper layer, a middle layer having a plurality of mounting holes disposed therethrough, the holes being sized and arranged to provide a user with a number of predetermined points at which to mount the ornamental article, and a bottom layer including a plurality of holes substantially aligned with the mounting holes of the middle layer;

selecting at least one of the plurality of holes in the bottom layer;

inserting a mounting member through the at least one of the plurality of holes in the bottom layer and through at least one corresponding mounting hole in the middle layer; and securing the mounting member to the pad.

9. The method of claim 8, further comprising the step of attaching the ornamental object to the mounting member.

10. The method of claim 8, further comprising the step of cutting slits through the upper, middle and bottom layers of the pad in order to receive a necklace therein.

11. A pad for mounting an ornamental article comprising:

an upper layer constructed and arranged to display the ornamental article;

a middle layer having a plurality of mounting holes disposed therethrough, the holes being sized and arranged to provide a user with a number of predetermined points at which to mount the ornamental article;

an intermediate layer disposed between the upper layer and the middle layer in order to substantially conceal the mounting holes of the middle layer to the user; and a bottom layer including a plurality of holes sized smaller than the mounting holes of the middle layer;

wherein in an assembled configuration a perimeter of the upper layer is wrapped around the edges of the middle layer and secured to a back surface thereof and the bottom layer is secured to an underside of the middle layer such that the plurality of holes in the bottom layer are substantially aligned with the plurality of mounting holes in the middle layer so that the user can easily identify the position of the mounting holes in the middle layer so as to readily mount the ornamental article to the pad.

12. The pad of claim 1, in combination with a display box having a top portion hinged to a bottom portion sized to receive the pad therein.

13. The pad of claim 1, wherein the middle layer includes a support backing having a top surface substantially covered with a cushioning material.

14. The pad of claim 1, wherein the mounting holes in the middle layer and plurality of holes in the bottom layer are arranged in multiple rows and columns.

15. The pad of claim 1, wherein the middle layer and the bottom layer include preformed slits provided in opposite comers thereof, the pre-formed slits being constructed and arranged to receive a necklace therein upon the user cutting corresponding slits into the upper layer of the pad.

16. The pad of claim 1, wherein the plurality of holes in the bottom layer are sized smaller than the mounting holes of the middle layer.

17. A pad for mounting an ornamental article comprising:

an upper layer constructed and arranged to display the ornamental article;

a middle layer having a plurality of mounting holes disposed therethrough, the holes being sized and arranged to provide a user with a number of predetermined points at which to mount the ornamental article;

a bottom layer including a plurality of holes sized smaller than the mounting holes of the middle layer;

an intermediate layer disposed between the upper layer and the middle layer;

wherein in an assembled configuration the plurality of holes in the bottom layer are substantially aligned with the plurality of mounting holes in the middle layer so that the user can easily identify the position of the mounting holes in the middle layer so as to readily mount the ornamental article to the pad.

18. A pad for mounting an ornamental article comprising:

an upper layer constructed and arranged to display the ornamental article;

a middle layer having a plurality of mounting holes disposed therethrough, the holes being sized and arranged to provide a user with a number of predetermined points at which to mount the ornamental article, said middle layer including a support backing having a top surface substantially covered with a cushioning material; and a bottom layer including a plurality of holes sized smaller than the mounting holes of the middle layer;

wherein in an assembled configuration the plurality of holes in the bottom layer are substantially aligned with the plurality of mounting holes in the middle layer so that the user can easily identify the position of the mounting holes in the middle layer so as to readily mount the ornamental article to the pad.

19. A pad for mounting an ornamental article comprising:

an upper layer constructed and arranged to display the ornamental article;

a middle layer having a plurality of mounting holes disposed therethrough, the holes being sized and arranged to provide a user with a number of predetermined points at which to mount the ornamental article; and a bottom layer including a plurality of holes sized smaller than the mounting holes of the middle layer;

wherein in an assembled configuration the plurality of holes in the bottom layer are substantially aligned with the plurality of mounting holes in the middle layer so that the user can easily identify the position of the mounting holes in the middle layer so as to readily mount the ornamental article to the pad;

said middle layer and said bottom layer including pre-formed slits provided in opposite corners thereof, the pre-formed slits being constructed and arranged to receive a necklace therein upon the user cutting corresponding slits into the upper layer of the pad.

20. A method of mounting an ornamental object onto a pad comprising the steps of:

providing a pad including an upper layer, a middle layer having a plurality of mounting holes disposed therethrough, the holes being sized and arranged to provide a user with a number of predetermined points at which to mount the ornamental article, and a bottom layer including a plurality of holes sized smaller than the mounting holes of the middle layer and substantially aligned therewith;

selecting at least one of the plurality of holes in the bottom layer;

inserting a mounting member through the at least one of the plurality of holes in the bottom layer and through at least one corresponding mounting hole in the middle layer;

securing the mounting member to the pad; and cutting slits through at least one of the upper, middle or bottom layer of the pad in order to receive a necklace therein.

* * * * *